United States Patent [19]

Whitehead et al.

[11] Patent Number: 4,747,977

[45] Date of Patent: May 31, 1988

[54] ETHANOL-FREE LIQUID LAUNDRY DETERGENT COMPOSITIONS

[75] Inventors: William A. Whitehead, Fort Mitchell, Ky.; Raymond D. Young, Fairfield, Ohio

[73] Assignee: The Procter & Gamble Company, Cincinnati, Ohio

[21] Appl. No.: 670,426

[22] Filed: Nov. 9, 1984

[51] Int. Cl.[4] ..... C11D 9/30; C11D 15/04

[52] U.S. Cl. ..... 252/111; 252/117; 252/118; 252/121; 252/132; 252/153; 252/173; 252/174.12; 252/174.19; 252/174.21; 252/547; 252/548; 252/553; 252/558; 252/559; 252/DIG. 12; 252/DIG. 14

[58] Field of Search ..... 252/111, 174.12, 105, 252/DIG. 12, DIG. 14, 118, 117, 132, 153

[56] References Cited

U.S. PATENT DOCUMENTS 3,501,535 3/1970 Stringer et al. ..... 260/632.5
3,761,420 9/1973 Bogardus ..... 252/171
3,860,536 1/1975 Landwerlen ..... 252/551
4,285,841 8/1981 Barrat et al. ..... 252/118
4,287,082 9/1981 Tolfo et al. ..... 252/174.12
4,507,219 3/1985 Hughes ..... 252/118

FOREIGN PATENT DOCUMENTS 0095205 11/1983 European Pat. Off. .

*Primary Examiner*—Paul Lieberman
*Assistant Examiner*—John F. McNally
*Attorney, Agent, or Firm*—Monte D. Witte; Richard C. Witte; Thomas H. O'Flaherty

[57] ABSTRACT

This invention relates to homogeneous liquid laundry detergent compositions containing a mixture of anionic and nonionic synthetic detergents, fatty acid soap, polycarboxylate builder, solvent, and water. Improved odor and safety are obtained by omitting $C_1$–$C_6$ monohydric alcohols which have been used in prior art compositions of this type, and using polyols exclusively for the solvent.

6 Claims, No Drawings

ETHANOL-FREE LIQUID LAUNDRY DETERGENT COMPOSITIONS

TECHNICAL FIELD

This invention relates to homogeneous, general purpose, heavy-duty liquid laundry detergent compositions containing a mixture of anionic and nonionic synthetic detergents, fatty acid soap, polycarboxylate builder, solvent and water. Improved odor and safety are obtained by omitting $C_1$–$C_6$ monohydric alcohols which have been used in prior art compositions of this particular type, and using polyols exclusively for the solvent.

BACKGROUND ART

Bogardus, U.S. Pat. No. 3,761,420 issued Sept. 25, 1973, and Landwerlen et al, U.S. Pat. No. 3,860,536 issued Jan. 14, 1975 disclosed liquid, enzyme-based, stain removal compositions intended primarily as laundry additives for spotting and soaking. In both patents, solutions of water and lower polyols were used to preserve enzymatic activity. Bogardus optionally used glassy phosphate as a chelating agent, while Landwerlen et al included anionic and/or nonionic surfactants and optionally solvents such as naphtha and other laundry additives to improve the removal of oil and grease stains in addition to the protein and carbohydrate stains removed by proteolytic and amylolytic enzyme, respectively.

Heavy duty liquids containing some or all of the ingredients recited in the preceding section have been the subject of prior art references. Barrat et al, U.S. Pat. No. 4,285,841 issued Aug. 25, 1981, related to general purpose, heavy duty laundry liquids containing a mixture of anionic and nonionic synthetic detergents and fatty acid soap, and phase regulant selected from among lower alphatic alcohols having 2–6 carbon atoms and 1–3 hydroxyl groups, esters of diethylene glycol, lower alphatic monoalcohols having 1–4 carbon atoms, detergent hydrotropes such as sodium toluene sulfonate, and water. All examples contained 5–10% ethanol. The objective of the invention was to secure superior textile cleaning through use of highly concentrated compositions, stablized by phase regulant. Odor was not mentioned.

Tolfo et al, U.S. Pat. No. 4,287,082 issued Sept. 1, 1981, disclosed similar compositions which additionally contained enzyme, enzyme-accessible calcium, and short chain carboxylic acid such as formic acid. Detergency was improved due to the presence of stabilized enzyme. Examples contained 10–12% ethanol. Odor was not mentioned.

Wertz et al, European Patent Publication No. 0095205 dated Nov. 30, 1983, disclosed liquid compositions containing anionic surfactant, nitrogen containing surfactant such as quaternary ammonium or amine or amine oxide surfactant, and fatty acid soap. The phase regulant mentioned as an optional component comprised, in the examples, mixtures of ethanol (1% minimum) and 1, 2-propane diol. The only mention of odor was in connection with order of addition of the components, and here the preferred product was referred to as having a "less objectionable" base odor.

Hughes, U.S. patent application Ser. No. 615,852 filed May 31, 1984, now U.S. Pat. No. 4,507,219 issued Mar. 26, 1985, was directed to compositions comprising combinations of sulfonate, alcohol ethoxylate sulfate, and ethoxylated nonionic surfactants; fatty acid; polycarboxylate builder; and a solvent system comprised of 2–10% ethanol, 2–15% lower polyol preferably propylene glycol, and water. Preferred compositions also included a quaternary ammonium or amine or amine oxide surfactant, and an alkanolamine in the amount of 0–0.04 mols per 100 gm. of composition. Exemplified compositions included 4.0–8.5% ethanol. Detergency, phase stability and bleach stability were the stated objectives of the invention. It was noted that while low levels of monoethanolamine were preferred to enhance product stability, detergency performance and odor, the amount should be minimized for best chlorine bleach compatability.

SUMMARIZED DISCLOSURE OF THE INVENTION

This invention is a homogeneous liquid laundry detergent composition, substantially free from $C_1$–$C_6$ monohydric alcohols, which comprises by weight of the composition:

(a) non-soap anionic surfactant in an amount from about 8% to about 33% on a surfactant acid basis;
(b) $C_{10}$–$C_{14}$ fatty acid soap in an amount from about 4% to about 20% on a fatty acid basis;
(c) ethoxylated nonionic surfactant in an amount from about 1% to about 15%;
(d) water-soluble polycarboxylate builder in an amount from about 1% to about 8% on a builder acid basis;
(e) neutralizing agent, selected from the group consisting of alkali metal hydroxides and at least about 2% alkanolamines, in a total amount sufficient to produce a pH for the composition of from about 7 to about 9 when measured as a 10 wt. % solution at 20° C.;
(f) enzyme selected from the group consisting of protease and amylase in an amount from about 0.05% to about 2%;
(g) aliphatic polyol having from 2 to 6 carbon atoms and from 2 to 4 hydroxyl groups in an amount from about 4% to about 25%;
(h) water in an amount from about 20% to about 70%; and wherein the sum of components (a), (b) and (c) is not greater than about 55%.

Especially preferred compositions include the following:

(1) The non-soap anionic surfactant is a mixture of (i) alkyl benzene sulfonate in which the alkyl group contains from about 9 to about 15 carbon atoms in straight or branched chain configuration and (ii) alkyl polyethoxy ether sulfate surfactant having an average of about 1 to about 6 —$CH_2CH_2O$— groups per molecule and in which the alkyl group contains 10 to 16 carbon atoms.
(2) The ethoxylated nonionic surfactant is the condensation product of 4 to 8 mols of ethylene oxide with 1 mol of straight or branched chain, primary or secondary alphatic alcohol having from 12 to 14 carbon atoms.
(3) The neutralizing agent includes from about 4% to about 12% monoethanolamine.
(4) The polycarboxylate builder is citric acid.
(5) The polyol is 1,2-propane diol (propylene glycol).

DETAILED DESCRIPTION OF THE INVENTION

In the paragraphs which follow, a description of each of the components of this invention is given seriatim. The problems to which this invention is directed, and their solutions, are described in the discussion hereinafter of Component (g)-Polyol Solvent.

Component (a). Non-Soap Anionic Surfactant

The detergent compositions herein contain from about 8% to about 33%, preferably from about 12% to about 25%, of non-soap anionic surfactant, expressed on a surfactant acid basis.

Preferred anionic non-soap surfactants are water soluble salts of alkyl benzene sulfonate, alkyl sulfate, alkyl polyethoxy ether sulfate, paraffin sulfonate, alpha-olefin sulfonate, alpha-sulfocarboxylates and their esters, alkyl glyceryl ether sulfonate, fatty acid monoglyceride sulfates and sulfonates, alkyl phenol polyethoxy ether sulfate, 2-acyloxy-alkane-1-sulfonate, and beta-alkyloxy alkane sulfonate.

Especially preferred alkyl benzene sulfonates have about 9 to about 15 carbon atoms in a linear or branched alkyl chain, more especially about 11 to about 13 carbon atoms. Especially preferred alkyl sulfate has about 8 to about 22 carbon atoms in the alkyl chain, more especially from about 12 to about 18 carbon atoms. Especially preferred alkyl polyethoxy ether sulfate has about 10 to about 18 carbon atoms in the alkyl chain and has an average of about 0.5 to about 12 —$CH_2CH_2O$— groups per molecule, especially about 10 to about 16 carbon atoms in the alkyl chain and an average of about 1 to about 6 —$CH_2CH_2O$— groups per molecule.

Especially preferred paraffin sulfonates are essentially linear and contain from about 8 to about 24 carbon atoms in the alkyl chain, more especially from about 14 to about 18 carbon atoms. Especially preferred alpha-olefin sulfonate has about 10 to about 24 carbon atoms in the alkyl chain, more especially about 14 to about 16 carbon atoms; alpha-olefin sulfonates can be made by reaction with sulfur trioxide followed by neutralization under conditions such that any sultones present are hydrolyzed to the corresponding hydroxy alkane sulfonates. Especially preferred alpha-sulfocarboxylates contain from about 6 to about 20 carbon atoms in the alkyl chain; included herein are not only the salts of alpha-sulfonated fatty acids but also their esters made from alcohols containing about 1 to about 14 carbon atoms.

Especially preferred alkyl glyceryl ether sulfonates are ethers of alcohols having about 10 to about 18 carbon atoms in the alkyl chain, more especially those derived from coconut oil and tallow. Especially preffered fatty acid monoglyceride sulfates and sulfonates have about 10 to about 18 carbon atoms in the alkyl chain. Especially preferred alkyl phenol polyethoxy ether sulfate has about 8 to about 12 carbon atoms in the alkyl chain and an average of about 1 to about 10 —$CH_2CH_2O$— groups per molecule. Especially preferred 2-acyloxyalkane-1-sulfonates contain from about 2 to about 9 carbon atoms in the aryl group and about 9 to about 23 carbon atoms in the alkane moiety. Especially preferred betaalkyloxy alkane sulfonate contains about 1 to about 3 carbon atoms in the alkyl group and about 8 to about 20 carbon atoms in the alkane moiety.

The alkyl chains of the foregoing non-soap anionic surfactants can be derived from natural sources such as coconut oil or tallow, or can be made synthetically as for example using the Ziegler or Oxo processes. Water solubility can be achieved by using alkali metal or alkanol-ammonium cations.

Mixtures of non-soap anionic surfactants are especially preferred. One particularly preferred mixture comprises an anionic sulfonate surfactant containing a $C_9$–$C_{15}$ alkyl or alkenyl group, more particularly salts of alkylbenzene sulfonates in which the alkyl group contains from about 9 to about 15 carbon atoms in straight or branched chain configuration, most particularly $C_{11}$–$C_{13}$ linear alkylbenzene sulfonate; mixed with a $C_{10}$–$C_{16}$ alkyl or hydroxyalkyl polyethoxy ether sulfate surfactant having an average of about 1 to about 6 —$CH_2CH_2O$— groups per molecule, more particularly a $C_{12}$–$C_{15}$ alkyl polyethoxy ether sulfate having an average of about 1 to about 3 —$CH_2CH_2O$— groups per molecule.

Preferred proportions of these mixtures are comprised of anionic sulfonate surfactant and polyethoxy ether sulfate surfactant in weight ratios from about 1:4 to about 4:1, more preferably from about 1:2.5 to about 1.5:1.

Component (b). Fatty Acid Soap

The detergent compositions herein contain fatty acid soap. It is convenient, however, to express the composition in terms of the fatty acid moiety thereof. It will be understood that compositions at the pH of this invention (about 7.0–9.0) contain a mixture of the free fatty acid species and the neutralized soap species.

The fatty acid moiety of the soaps of this invention is a saturated fatty acid containing from about 10 to about 14 carbon atoms. The weight ratio of $C_{10-12}$ fatty acid to $C_{14}$ fatty acid is preferably at least about 1:1, more preferably at least about 1.5:1. Soaps can be made by direct saponification of natural fats and oils such as coconut oil and palm kernel oil, or by the neutralization of free fatty acids obtained from either natural or synthetic sources. Preferred are coconut fatty acids; palm kernel fatty acids; and mixtures of lauric and myristic acid in weight ratio from about 1:1 to about 5:1. Oleic acid may be added in minor amount, i.e. up to about 50% of the total fatty acid, and when so used is considered to be a part of component (b).

The amount of fatty acid soap in the compositions of this invention, expressed on a fatty acid basis, is from about 4% to about 20%, preferably from about 6% to about 15%.

Component (c). Ethoxylated Nonionic Surfactant

Preferred nonionic surfactants are water soluble compounds produced by the condensation of ethylene oxide with a hydrophobic compound such as an alcohol, alkyl phenol, polypropoxy glycol, or polypropoxy ethylene diamine.

Especially preferred polyethoxy alcohols are the condensation products of about 3 to about 9 mols of ethylene oxide with 1 mol of branched or straight chain, primary or secondary aliphatic alcohol having from about 10 to about 16 carbon atoms; more especially about 4 to about 8 mols of ethylene oxide condensed with 1 mol of straight or branched chain, primary or secondary aliphatic alcohol having from about 12 to about 14 carbon atoms. Certain species of polyethoxy alcohols are commercially available from the Shell Chemical Company under the trade name "Neodol".

Especially preferred polyethoxy alkyl phenols are the condensation products of about 3 to about 9 mols of ethylene oxide with 1 mol of alkyl phenol having a branched or straight chain alkyl group containing about 8 to about 12 carbon atoms. Certain species of polyethoxy alkyl phenols are commercially available from the GAF Corporation under the trade name "Igepal".

Especially preferred polyethoxy polypropoxy glycols are commercially available from BASF-Wyandotte under the trade name "Pluronic". Especially preferred condensates of ethylene oxide with the reaction product of propylene oxide and ethylene diamine are commercially available from BASF-Wyandotte under the trade name "Tetronic".

Particularly preferred ethoxylated nonionic surfactants are condensation products of about 6.5 mols of ethylene oxide with 1 mol of $C_{12}$–$C_{13}$ straight chain primary or secondary aliphatic alcohol.

Ethoxylated nonionic surfactants are used in amounts from 1% to about 15%, preferably from about 2% to about 10%, more preferably from about 4% to about 8%, by weight of the composition. The weight ratio of ethoxylated nonionic surfactant to non-soap anionic surfactant is preferably from about 1:10 to about 1:1, more preferably from about 1:5 to about 1:2.

The ethoxylated nonionic surfactants of this invention preferably have an HLB (hydrophilic/lipophilic balance) of from about 10 to about 13.

The sum of components (a), (b) and (c) of this invention is not greater than about 55%, preferably not greater than about 45%, by weight of the composition.

Component (d). Polycarboxylate Builder

Another essential component of the compositions of this invention is polycarboxylate detergent builder. The various aminopolycarboxylates, cycloalkane polycarboxylates, ether polycarboxylates, alkyl polycarboxylates, epoxy polycarboxylates, tetrahydrofuran polycarboxylates, benzene polycarboxylates, and polyacetal polycarboxylates are suitable for use herein.

Examples of such polycarboxylate builders are the water-soluble salts of mellitic acid, citric acid, pyromellitic acid, benzene pentacarboxylic acid, oxydiacetic acid, carboxymethyloxysuccinic acid, carboxymethyloxymalonic acid, cis-cyclohexanehexacarboxylic acid, cis-cyclohexanehexacarboxylic acid, oxydisuccinic acid, ethylenediaminetetraacetic acid; nitrilotriacetic acid; and phytic acid. Polycarboxylate builders are described in Leikhim et al, U.S. Pat. No. 4,284,532 issued Aug. 18, 1981; Eckey, U.S. Pat. No. 1,739,942 issued Mar. 27, 1956; Diehl, U.S. Pat. No. 3,308,067 issued Mar. 7, 1967; and Crutchfield et al, U.S. Pat. Nos. 4,144,226 issued Mar. 13, 1979 and 4,146,495 issued Mar. 27, 1979; all of which are hereby incorporated herein by reference.

Useful polycarboxylate detergent builders also include the water-soluble salts of polymeric aliphatic polycarboxylic acids having the following structural and physical characteristics: (a) a minimum molecular weight of about 350 calculated as to the acid form; (b) an equivalent weight of about 50 to about 80 calculated as to acid form; (3) at least 45 mol percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of such builders are the polymers and copolymers of itaconic acid, aconitic acid, maleic acid, mesaconic acid, fumaric acid, methylene malonic acid, and citraconic acid.

Citric acid is a preferred polycarboxylate builder.

The compositions of this invention contain from about 1% to about 8%, preferably from about 2% to about 6%, of polycarboxylate detergent builder.

Component (e). Neutralization Agent

The compositions of this invention have a pH of about 7 to about 9 when measured as a 10 wt. % solution at 20° C. This is achieved by adding appropriate amounts of one or more bases to the portions of the composition that may be obtained in their acidic form; sulfonic and/or sulfuric detergent acids, fatty acid, polycarboxylate builder acid, and perhaps certain minor ingredients. These bases are comprised of alkall metal hydroxides, alkanolamines, and mixtures thereof, preferably selected from among sodium and potassium hydroxides and mono-, di-, and tri-ethanolamines.

Good solubilization and phase stabilization are achieved by using at least about 2% alkanolamine by weight of the composition. Preferred usage is from about 2% to about 18% alkanolamine, more preferably from about 4% to about 12% monoethanolamine, by weight of the composition.

As is well known, higher concentrations of the solid components of the composition or achievement of greater physical stability for the homogeneity of the composition tend to require relatively more potassium and less sodium. Accordingly, when alkali metal hydroxides are used in such circumstances, the molar ratio of sodium to potassium in the finished composition is preferably from about 1:10 to about 4:3, more preferably from about 3:5 to about 1:1.

Component (f). Enzyme

The compositions of this invention contain enzymes in an amount of from about 0.05% to about 2%, preferably from about 0.1% to about 1.5%. Protease, amylase, or mixtures thereof can be used.

Preferred proteolytic enzymes provide a proteolytic activity of at least about 5 Anson Units (about 1,000,000 Delft Units) per liter of liquid detergent composition, preferably from about 10 to about 40 Anson Units. Suitable proteolytic enzymes include the many species known to be adapted for use in detergent compositions. Commercial enzyme preparations such as "Alcalase" sold by Novo Industries A/S, Copenhagen, Denmark, and "Maxatase" sold by Gist-Brocades, Delft, The Netherlands, are suitable. Other preferred proteolytic enzyme compositions include those commercially available under the tradenames SP-72 ("Esperase") manufactured and sold by Novo Industries and "AZ-Protease" manufactured and sold by Gist-Brocades. A more complete disclosure of suitable proteolytic enzymes can be found in U.S. Pat. No. 4,101,457, Place et al, issued Jul. 18, 1978, incorporated herein by reference.

Alpha-amylases are also suitable for use in the compositions of this invention. They are used in amounts comparable with protease usage. When both protease and amylase are used, their weight ratio is preferably from about 30:1 to about 3:1. Suitable amylases include "Rapidase" sold by Gist-Brocades and "Termamyl" sold by Novo Industries. More complete disclosures of suitable amylases are given in U.S. Pat. No. 3,790,482, Jones et al, issued Feb. 5, 1974, and EPO publication 0118933, Severson, published Sept. 19, 1984, both incorporated herein by reference.

Component (g). Polyol Solvent

When added to the compositions described herein, monohydric alcohols have been found to cause malodors that are distinctly noticeable whether or not perfume is present. Monohydric alcohols are highly volatile, with boiling points in °C. ranging from 65 for methanol to 78 for ethanol to 97 for n-propanol to 156 for n-hexanol, with branched chain alcohols boiling lower than the n-alcohols for each series of homologs. It is believed that these malodors result from two causes: first, the sharp intrinsic odor of these volatile compounds per se; and secondly, and more importantly, the propensity of these volatile compounds to lift up and carry the odors of other portions of the composition that may be unpleasant. The alkanolamines, including mono-, di- and tri-ethanolamine, are major sources of malodors. Enzymes are other important sources. To a lesser extent, but still noticeable, are malodors arising from fatty acids and the impurities and side reaction products present in commerically available surfactant raw materials.

It is well known that malodors of this kind, even in a perfumed product, and even though they do not affect detergency or other performance characteristics, can exert a strong influence on potential customers in the marketplace. Indeed, the economic importance of good product odor can hardly be overstated.

Accordingly, the compositions of this invention are substantially free of $C_1$–$C_6$ monohydric alcohols. By substantially free is meant that no more than a trace is present; i.e., no more than a fractional percentage such as may for example be brought in as impurity in one or more raw materials of the composition.

The solvents which comprise component (f) of the compositions of this invention are allphatic polyols having from 2 to 6, preferably from 2 to 4, carbon atoms; and from 2 to 4, preferably 2 or 3, hydroxyl groups. Specific solvents utilizable in this invention are ethylene glycol, propylene glycol, (1,2-propane diol), trimethylene glycol, diethylene glycol, hexylene glycol and glycerine. 1,2-propane diol is a preferred solvent. Its boiling point is 189° C., and all other polyols specifically mentioned above boil at even higher temperatures. Even the lowest boiling polyol within the scope of this invention boils within a few degrees of the temperature cited above.

These polyols are used in the composition in amounts of from about 4% to about 25%, preferably from about 7% to about 20%, most preferably from about 9% to about 14% by weight of the composition.

Another advantage contributed by the polyols, through their lower volatility, is safety. It is common knowledge that a manufacturing facility handling any of the lower alcohols must be carefully (and expensively) designed, constructed, maintained and operated to be safe from fire and explosion. Furthermore, finished liquid detergent compositions containing significant amounts of the lower alcohols have relatively low flash points. Closed cup flash points of comparable samples are raised about 30° C., when the solvent is switched from an ethanol/polyol mixture of the prior art to an all-polyol system. This is a meaningful contribution to safety in manufacturing, in warehousing, in shipping (especially by air where flashpoint regulations are strict), on the grocery store shelf, and in consumers' homes.

Component (h) Water

Component (h) of the composition of this invention is water, which is used an amount from about 20% to about 70%, preferably from about 28% to about 50%, by weight of the composition.

The compositions of this invention, using mixtures of polyols and water for stabilization, are homogeneous, isotropic solutions at room temperature. Within the ranges of usage identified herein, it is within the capability of a person of ordinary skill in the art to adjust percentages of the various components to improve phase stability at elevated or reduced temperatures or during freeze/thaw cycles, or to maintain a fixed degree of phase stability while diluting the formula to reduce cost or concentrating it to improve performance.

Optional Components

Cosurfactant. In addition to the surfactants which constitute elements (a), (b) and (c) of this invention, a cosurfactant selected from certain quaternary ammonium, amine and amine oxide surfactants can optionally be used at levels from about 0.5% to about 5%, preferably from about 1% to about 3%, by weight of the composition.

The quaternary ammonium surfactants useful herein are of the formula:

$$[R^2(OR^3)_y][R^4(OR^3)_y]_2R^5N^{+X-}$$

wherein $R^2$ is an alkyl or alkyl benzyl group having from about 6 to about 16 carbon atoms in the alkyl chain; each $R^3$ is selected from the group consisting of $-CH_2CH_2-$, $-CH_2CH(CH_3)-$, $-CH_2CH_4(CH_2OH)-$, $-CH_2CH_2CH_2-$, and mixtures thereof; each $R^4$ is selected from the group consisting of $C_1$–$C_4$ alkyl, $C_1$–$C_4$ hydroxyalkyl, benzyl, and hydrogen when y is not 0; $R^5$ is the same as $R^4$ or is an alkyl chain wherein the total number of carbon atoms of $R^2$ plus $R^5$ is from about 8 to about 16; each y is from 0 to about 10 and the sum of the y values is from 0 to about 15; and X is any compatible anion.

Preferred of the above are the alkyl quaternary ammonium surfactants, especially the mono-long chain alkyl surfactants described in the above formula when $R^5$ is selected from the same groups as $R^4$. The most preferred quaternary ammonium surfactants are the chloride, bromide and methylsulfate $C_{8-16}$ alkyl trimethylammonium salts, $C_{8-16}$ alkyl di(hydroxyethyl)methylammonium salts, the $C_{8-16}$ alkyl hydroxyethyldimethylammonium salts, $C_{8-16}$ alkyloxypropyl trimethylammonium salts, and the $C_{8-16}$ alkyloxypropyl dihydroxyethylmethylammonium salts. Of the above, the $C_{10}$–$C_{14}$ alkyl trimethylammonium salts are preferred, e.g., decyl trimethylammonium methylsulfate, lauryl trimethylammonium chloride, myristyltrimethylammonium bromide and coconut trimethylammonium chloride and methylsulfate.

Under cool water washing conditions, i.e., less than about 20° C., the $C_{8-10}$ alkyl trimethylammonium surfactants are particularly preferred since they have lower Krafft boundaries and crystallization temperatures than the longer chain quaternary ammonium surfactants.

Amine surfactants useful herein are of the formula:

$$[R^2(OR^3)_y][R^4(OR^3)_y]R^5N$$

wherein the $R^2$, $R^3$, $R^4$, $R^5$ and y substituents are as defined above for the quaternary ammonium surfactants. Particularly preferred are the $C_{12-16}$ alkyl dimethyl amines.

Amine oxide surfactants useful herein are of the formula:

$$[R^2(OR^3)_y][R^4(OR^3)_y]R^5N \rightarrow O$$

wherein the $R^2$, $R^3$, $R^4$, $R^5$ and y substituents are also as defined above for the quaternary ammonium surfactants. Particularly preferred are the $C_{12-16}$ alkyl dimethyl amine oxides.

Enzyme Stabilizer. Enzymes are desirably stabilized by using a mixture of a short chain carboxylic acid salt and calcium ion, such as disclosed in U.S. Pat. No. 4,318,818. Letton et al, issued Mar. 9, 1982, incorporated herein by reference.

The short chain carboxylic acid salt is preferably water-soluble and most preferably is a formate, e.g., sodium formate. The short chain carboxylic acid salt is used at a level from about 0.25% to about 10%, preferably from about 0.3% to about 3%, more preferably from about 0.5% to about 1.5% by weight of the composition. Any water-soluble calcium salt can be used as a source of calcium ion, including calcium acetate, calcium formate and calcium propionate. The composition should contain from about 0.1 to about 30 millimols of calcium ion per liter, preferably from about 0.5 to about 15 millimols of calcium ion per liter. When materials are present which complex calcium ion, it is necessary to use high levels of calcium ion so that there is always some minimum level available for the enzyme.

Protease is preferably stabilized in the present compositions by the addition of from about 0.25% to about 10%, more preferably from about 0.5% to about 5%, most preferably from about 0.75% to about 3%, by weight of boric acid or a compound capable of forming boric acid in the composition (calculated on the basis of the boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid. Boric acid type enzyme stabilizers are described more fully in Severson, U.S. Patent Application Ser. Nos. 609,944 and 609,945, both filed on May 14, 1984 and both incorporated herein by reference.

Other Optional Components for use in the liquid detergents herein include polyacids, soil removal agents, antiredeposition agents, suds regulants, hydrotropes, opacifiers, antioxidants, bactericides, dyes, perfumes, and brighteners as described in U.S. Pat. No. 4,285,841, Barrat et al, issued Aug. 25, 1981, incorporated herein by reference. Such optional components generally represent less than about 15%, preferably from about 2% to about 10%, by weight of the composition.

Preferred compositions contain from about 0.01% to about 1% of a polyacid or salt thereof to enhance pretreatment performance. Preferred polyacids for use herein are ethylenediamine tetramethylenephosphonic acid, diethylene triamine pentamethylenephosphonic acid, and diethylenetriamine pentaacetic acid, or the salts thereof. These polyacids/salts are preferably used in an amount from about 0.1% to about 0.8%.

Preferred compositions also contain from about 0.5% to about 3%, preferably from about 1% to about 2%, by weight of the composition of a highly ethoxylated polyethyleneamine or polyethyleneimine soil removal and antiredeposition agent, such as those described in pending U.S. patent application Ser. No. 452,463, Vander Meer, filed Dec. 23, 1982. A particularly preferred material is tetraethylene pentaimine ethoxylated with about 15–18 mols of ethylene oxide at each hydrogen site.

A preferred suds regulant is the silicone/silica mixture disclosed in Bartolotta et al, U.S. Pat. No. 3,933,672 issued Jan. 20, 1976. These materials are typically, though not necessarily, used in fractional percentages of the composition by weight. They are not soluble in the remainder of the composition, but stay suspended as finely dispersed droplets and particles, respectively. Even though compositions containing minor amounts of these materials may not be isotropic within the narrow technical meaning of that word, they are considered herein to be compositions within the scope of this invention.

Processing

The complete compositions of this invention at equilibrium, at room temperature, are homogeneous, isotropic liquids. The components thereof, when mixed thoroughly together in any fashion, will ultimately form this phase. It is convenient, however, to add the components in an order and a manner that will avoid the temporary formation of intermediate non-isotropic phases. The process described in detail hereinafter in the preparation of Composition A, with polyol substituted for ethanol, is such a convenient process.

INDUSTRIAL APPLICATION

The following examples describe the formulation and processing of certain compositions of this invention and the benefits obtained therefrom as compared with certain other compositions. They are illustrative of the invention and are not to be construed as limiting thereof.

Composition A according to the teachings of the prior art was prepared and formulated as follows:

(a) A caustic "seat" was prepared by premixing 129.9 gm. $H_2O$, 18.4 gm. of a 48.8% solution of NaOH, 20.9 gm. of a 45% solution of KOH, 14.0 gm. of pentasodium diethylene triamine pentaacetic acid (43% active), and 70 gm. monoethanolamine.

(b) A builder premix was prepared by mixing 50.0 gm. $H_2O$, 1.6 gm. calcium hydroxide (97% active), 46.0 gm. citric acid (anhydrous), and 6.9 gm. sodium formate.

(c) A brightener premix was prepared by mixing 20.0 gm. $H_2O$, 20 gm. of ethanol (92.5% active), and 1.8 gm. brightener.

The final composition was prepared by adding the components together, with continuous mixing, in the following order: caustic seat, builder premix, 74.7 gms. of $C_{13}$ linear alkyl benzene sulfonate (96.4% active), brightener premix, 50.3 gm. ethanol, 216.3 gm. of $C_{14}$–$C_{15}$ alkyl polyethoxy ether sulfate paste having 1.9 (avg.) —$CH_2CH_2O$— groups per molecule (49.9% active paste*), 150 gm. of lauric/myristic acid (1/1 wt. ratio), 65 gm. of $C_{12-13}$ alkyl polyethoxylate having 6.5 (avg.) —$CH_2CH_2O$— groups per molecule, and 12.5 gm. of tetraethylene pentaimine ethoxylate having 15–18 (avg.) —$CH_2CH_2O$— groups per hydrogen site.

* Contained 18.7% 1,2-propane diol, or 40.4 gm. and 1.5% sodium formate, or 3.2 gm.

The pH was adjusted with 20.0 gm. of NaOH (100% basis), enzymes were added in the form of 8.2 gm. Maxatase and 1.7 gm. Termamyl, and finally 2.0 gm. perfume was added. Total batch size was 1000 gm.

Components were present in the following proportons, some of them being specified on an acid basis:

| Component | parts by weight Comp. A | Comp. H |
|---|---|---|
| $C_{13}$ linear alkyl benzene sulfonc acid. | 7.2 | 10.4 |
| $C_{14-15}$ alkyl polyethoxy ether sulfonic acid having 1.9 (avg.) —$CH_2CH_2O$— groups per molecule | 10.8 | 10.4 |
| $C_{12-13}$ alkyl polyethoxylate having 6.5 (avg.) —$CH_2CH_2O$— groups per molecule | 6.5 | 5.5 |
| $C_{12}/C_{14}$ fatty acid (3/1 wt. ratio) | 15.0 | 10.5 |
| citric acid (anhydrous) | 4.6 | 3.0 |
| monoethanolamine | 7.0 | 6.0 |
| protease (Maxatase) | 1.0 | 1.0 |
| amylase (Termamyl) | 0.17 | 0.17 |
| diethylene triamine pentaacetic acid | 0.60 | 0.30 |
| tetraethylene pentaimine ethoxylate having 15–18 (avg.) —$CH_2$—$CH_2O$— groups per hydrogen site | 1.0 | 1.5 |
| calcium hydroxide | 0.15 | 0.08 |
| sodium formate | 1.0 | 1.0 |
| brighteners | 0.18 | 0.18 |
| perfume | 0.20 | 0.20 |
| solvent | | |
| ethanol | 6.5 | 0 |
| 1,2-propane diol | 4.0 | 9.0 |
| NaOH | 2.9 | 2.4 |
| KOH | 0.94 | 0.75 |
| water | balance | balance |
| | 100 | 92.91 |

Composition A was an isotropic liquid as made at room temperature (20° C). Its pH was 8.3 when measured on a 10% solution of the composition at 20° C. Its odor was not pleasant.

Then was prepared in the same manner a series of compositions which were like Composition A except that in each case perfume and one or more other components were omitted and replaced with additional water. These compositions were as follows:

| Compostion | Component(s) Omitted |
|---|---|
| B | enzymes, fatty acids, ethanol, and monoethanolamine |
| C | ethanol |
| D | monoethanolamine (replaced by NaOH equivalent) |
| E | enzymes |
| F | fatty acid |
| G | alkyl polyethoxy ether sulfonate paste |

All of Compositions B through C were isotropic at room temperature. All pH's were within the range 8–9 except for Compositions B and F where pH adjustments were not made.

A panel of experts judged the odor of the samples to be in the order listed above. Composition B, which contained fewest ingredients that cause malodor, was best. Composition C, which contained no ethanol, was nearly as good, even with both monoethanol amine and enzyme present. Compositions D and E were poor, while F and G were even worse and about equal to each other.

In Compositions D and E, the ethanol is believed to have lifted up and emphasized the grainy/meaty malodor of the enzyme and the painty, metallic malodor of the monoethanolamine, respectively. In Compositions F and G, the ethanol lifted up the malodors of both the monoethanolamine and the enzyme.

Composition C is an example of this invention. Compositions A, B, D, E, F and G are comparative examples.

Another composition, which is identified in detail hereinbefore as Composition H, was prepared in the same manner as was Composition A except for differences in the amounts of the various components. As noted, the components added up to less than 100 parts because it was intended that a "hole" be left in the formula for addition of varying mixtures of additional solvents. Each of Compositions through V that are identified below was prepared by adding, to Composition H, amounts of 1,2-propane diol, ethanol and/or water sufficient to make 99.8 total parts. [The 0.2 parts "hole" left for adding perfume was never filled.] These components contained solvent mixtures as follows:

| Composition | Parts solvent per 99.8 parts total composition: ethanol | 1,2-propane diol | total | solvent Ratio |
|---|---|---|---|---|
| I | 0 | 9.0 | 9 | 0 |
| J | 0 | 10.35 | 10.35 | 0 |
| K | 0 | 11.0 | 11.0 | 0 |
| L | 0 | 12.0 | 12.0 | 0 |
| M | 0 | 13.0 | 13.0 | 0 |
| N | 0 | 14.0 | 14.0 | 0 |
| O | 1.62 | 11.38 | 13.0 | 1/7 |
| P | 1.75 | 12.25 | 14.0 | 1/7 |
| Q | 2.25 | 6.75 | 9.0 | 1/3 |
| R | 2.60 | 7.75 | 10.35 | 1/3 |
| S | 2.75 | 8.25 | 11.0 | 1/3 |
| T | 3.0 | 9.0 | 12.0 | 1/3 |
| U | 3.25 | 9.75 | 13.0 | 1/3 |
| V | 3.5 | 10.5 | 14.0 | 1/3 |

All compositions 1 through V were homogeneous and isotropic as made at 20° C. and remained so upon storage indefinitely at room temperature or up to two months exposure to elevated temperature (38° C.). All compositions except I, J and Q, which contained relatively low solvent levels as compared with their levels of surfactants and other solids, recovered their isotropic character perfectly after being subjected to three freeze/thaw cycles (4° C./20° C.). In general, the higher the level of total solvent the lower the temperature that the compositions withstood for prolonged periods without losing their isotropic character, with the best of them being good for 2 months at −4° C. Ethanol was somewhat more effective than 1,2-propane diol on a part-for-part basis.

The odor of Compositions 1 through N, which contained no ethanol and were Compositions of this invention, was good. The odor of Compositions O through U, comparative examples which contained 1.62% ethanol or more, was poor.

The detergent performance of all compositions I through V is good.

Composition W was prepared in the same manner as Compositions I through V and contained 6.5 parts ethanol plus 3.9 parts 1,2-propane diol, making a total of 10.4 parts solvent and a solvent ratio of 5/3 expressed in the terms of the preceding table. Flash points were measured for this composition and for Composition N, which was the same except for solvent content. Results were as follows:

| Composition | Parts ethanol | Parts 1-2 propane diol | Flash Point (closed cup) |
|---|---|---|---|
| W | 6.5 | 3.9 | 40° C. |
| N | 0 | 14.0 | 71° C. |

Composition N, an example of this invention, had a significantly higher, and therefore safer, flash point than Composition W, a comparative example.

What is claimed is:

1. A homogeneous liquid laundry detergent composition, substantially free from $C_1$–$C_6$ monohydric alcohols, which comprises by weight of the composition:

(A) non-soap anionic surfactant in an amount from about 8% to about 33% on a surfactant acid basis;

(B) $C_{10}$–$C_{14}$ fatty acid soap in an amount from about 4% to about 20% on a fatty acid basis;

(C) ethoxylated nonionic surfactant in an amount from about 1% to about 15%;

(D) water-soluble polycarboxylate builder in an amount from about 1% to about 8% on a builder acid basis;

(E) neutralizing agent, selected from the group consisting of alkali metal hydroxides and at least about 2% alkanolamines, in a total amount sufficient to produce a pH for the composition of from about 7 to about 9 when measured as a 10 wt. % solution at 20° C.;

(F) enzyme selected from the group consisting of protease and amylase in an amount from about 0.05% to about 2%;

(G) aliphatic polyol having from 2 to 6 carbon atoms and from 2 to 4 hydroxyl groups in an amount from about 4% to about 25%;

(H) water in an amount from about 20% to about 70%; and wherein the sum of components (A), (B) and (C) is not greater than about 55%.

2. The composition of claim 1 wherein:

(i) the anionic surfactant is selected from the group consisting of water soluble salts of alkyl benzene sulfonates having about 9 to about 15 carbon atoms in linear or branched alkyl chain, alkyl sulfate having about 8 to about 22 carbon atoms in the alkyl chain, alkyl polyethoxy ether sulfate having about 10 to about 18 carbon atoms in the alkyl chain and an average of about 0.5 to about 12 —$CH_2CH_2O$— groups per molecule, paraffin sulfonate having about 8 to about 24 carbon atoms in the alkyl chain, alpha-olefin sulfonate having about 10 to about 24 carbon atoms in the alkyl chain, alpha-sulfocarboxylates having about 6 to about 20 carbon atoms in the alkyl chain and their esters made from alcohols containing about 1 to about 14 carbon atoms, alkyl glyceryl ether sulfonate having about 10 to about 18 carbon atoms in the alkyl chain, fatty acid monoglyceride sulfates and sulfonates having about 10 to about 18 carbon atoms in the alkyl chains, alkyl phenol polyethoxy ether sulfate having about 8 to about 12 carbon atoms in the alkyl chain and an average of about 1 to about 10 —$CH_2CH_2O$— groups per molecule, 2-acyloxyalkane-1-sulfonate having about 2 to about 9 carbon atoms in the aryl group and about 9 to about 23 carbon atoms in the alkane moiety, and beta-alkyloxy alkane sulfonate having about 1 to about 3 carbon atoms in the alkyl group and about 8 to about 20 carbon atoms in the alkane moiety:

(ii) the fatty acid soap is saturated and contains from about 10 to about 14 carbon atoms in proportions such that the weight ratio, on a fatty acid basis, of $C_{10-12}$ fatty acid to $C_{14}$ fatty acid is at least about 1:1; and (iii) the ethoxylated nonionic surfactant is selected from the group consisting of water soluble compounds produced by the condensation of about 3 to about 9 mols of ethylene oxide with 1 mol of branched or straight chain, primary or secondary aliphatic alcohol having from about 10 to about 16 carbon atoms or with 1 mol of alkyl phenol having a branched or straight chain alkyl group having from about 8 to about 12 carbon atoms.

3. The composition of claim 2 that additionally contains a cosurfactant comprised of a quaternary ammonium, amine or amine oxide surfactant in an amount from about 0.5% to about 5% by weight of the composition.

4. The composition of claim 2 wherein:

(i) the non-soap anionic surfactant is in an amount from about 12% to about 25% by weight of the composition, expressed on a surfactant acid basis, and is comprised of a mixture of (a) alkyl benzene sulfonate having from about 11 to about 13 carbon atoms in a linear or branched alkyl chain and (b) alkyl polyethoxy ether sulfate having from 10 to about 16 carbon atoms and an average of about 1 to about 6 —$CH_2CH_2O$— groups per molecule; in proportions by weight from about 1:4 to about 4:1;

(ii) the ethoxylated nonionic surfactant is in an amount from about 2% to about 8% by weight of the composition and is in weight ratio of from about 1:10 to about 1:1 to the non-soap anionic surfactant; and is the condensation product of about 4 to about 8 mols of ethylene oxide with 1 mol of straight or branched chain, primary or secondary aliphatic alcohol having from about 12 to about 14 carbon atoms;

(iii) the polycarboxylate builder, expressed on an acid basis, is from about 2% to about 6% by weight of the composition;

(iv) a portion of the neutralization agent is comprised of monoethanolamine, diethanolamine, or triethanolamine in an amount from about 2% to about 18% by weight of the composition;

(v) the enzyme is from about 0.1% to about 1.5% by weight of the composition; and (vi) the polyol is from about 7% to about 20% by weight of the composition and has 3 or 4 carbon atoms and 2 or 3 hydroxyl groups.

5. The composition of claim 4 wherein (i) the fatty acid soap is in an amount, expressed on a fatty acid basis, from about 6% to about 15% by weight of the composition; (ii) a portion of the neutralization agent is comprised of monoethanolamine in an amount from about 4% to about 12% by weight of the composition; and (iii) the polyol is from about 9% to about 14% by weight of the composition.

6. The composition of claim 5 wherein:

(i) the non-soap anionic surfactant is comprised of a mixture of (a) alkyl benzene sulfonate having from about 11 to about 13 carbon atoms in a linear or branched alkyl chain and (b) alkyl polyethoxy ether sulfate having from about 12 to about 15 carbon atoms and an average of about 1 to about 3 —$CH_2CH_2O$— groups per molecule, in proportions by weight from about 1:2.5 to about 1.5:1;

(ii) the polycarboxylate builder is citric acid;
(iii) the polyol is 1,2-propane diol; and
(iv) the composition additionally contains an enzyme stabilizing agent selected from the group consisting of short chain carboxylic acid salt in an amount from about 0.25% to about 10% by weight of the composition; a water soluble calcium salt in an amount sufficient to provide from about 0.1 to about 30 millimols of calcium ion per liter of detergent solution; and boric acid or a compound capable of forming boric acid in an amount of from about 0.25% to about 10%, calculated on a boric acid basis, by weight of the composition.

* * * * *

UNITED STATES PATENT AND TRADEMARK OFFICE

CERTIFICATE OF CORRECTION

PATENT NO. : 4,747,977

DATED : May 31, 1988

INVENTOR(S) : William A. Whitehead and Raymond D. Young

It is certified that error appears in the above-identified patent and that said Letters Patent is hereby corrected as shown below:

Column 3, at line 53: "preffered" should read --preferred--
Column 5, at line 44: "cis-cyclohexanehexacarboxylic" should read --cis-cyclopentanetetracarboxylic--
Column 6, at line 16: "alkall" should read --alkali--
Column 7, at line 37: "allphatic" should read --aliphatic--
Column 8, at line 30: "$[R^2(OR^3)_y][R^4(OR^3)_y]_2R^5N+^{X-}$" should read --$[R^2(OR^3)_y][R^4(OR^3)_y]_2R^5N^+X^-$--
Column 8, at line 35: "$-CH_2CH_4(CH_2OH$ should read $-CH_2CH(CH_2OH$--
Column 12, at line 15: "Compositions through V" should read --Compositions I through V--
Column 12, at line 39: "compositions 1 through V" should read --compositions I through V--
Column 12, at line 55: "Compositions 1 through N" should read --Compositions I through N--
Column 13, at line 43: "in linear" should read --in a linear--

Signed and Sealed this

Twenty-fourth Day of January, 1989

*Attest:*

DONALD J. QUIGG

*Attesting Officer*

*Commissioner of Patents and Trademarks*